US007459868B2

(12) United States Patent
Yoo et al.

(10) Patent No.: US 7,459,868 B2
(45) Date of Patent: Dec. 2, 2008

(54) APPARATUS FOR CONTROLLING OPERATION OF RECIPROCATING COMPRESSOR AND METHOD THEREOF

(75) Inventors: Jae Yoo Yoo, Gyeonggi-Do (KR); Min Gyu Hwang, Gyeonggi-Do (KR); Chel Woong Lee, Seoul (KR)

(73) Assignee: LG Electronics, Inc., Seoul (KR)

( * ) Notice: Subject to any disclaimer, the term of this patent is extended or adjusted under 35 U.S.C. 154(b) by 375 days.

(21) Appl. No.: 11/269,691

(22) Filed: Nov. 9, 2005

(65) Prior Publication Data

US 2006/0251524 A1 Nov. 9, 2006

(30) Foreign Application Priority Data

May 6, 2005 (KR) ..... 10-2005-0038133
May 6, 2005 (KR) ..... 10-2005-0038136
May 6, 2005 (KR) ..... 10-2005-0038137

(51) Int. Cl.
*H02P 1/00* (2006.01)

(52) U.S. Cl. ..... 318/119; 318/135; 417/44.1

(58) Field of Classification Search ..... 318/430–434, 318/443, 470, 561, 632; 417/45, 44.1, 417
See application file for complete search history.

(56) References Cited

U.S. PATENT DOCUMENTS 5,342,176 A * 8/1994 Redlich ..... 417/212
6,084,320 A * 7/2000 Morita et al. ..... 310/12
6,153,951 A * 11/2000 Morita et al. ..... 310/12
6,682,310 B2 * 1/2004 Yoo et al. ..... 417/42
6,779,982 B2 * 8/2004 Heo ..... 417/44.11
6,811,380 B2 * 11/2004 Kim ..... 417/44.1
6,815,922 B2 * 11/2004 Yoo et al. ..... 318/632
7,245,101 B2 * 7/2007 Dadd ..... 318/561
2002/0051710 A1 * 5/2002 Yoo et al. ..... 417/44.11
2002/0062652 A1 * 5/2002 Hwang et al. ..... 62/228.3
2002/0064463 A1 * 5/2002 Park et al. ..... 417/44.1
2002/0064464 A1 * 5/2002 Hwang et al. ..... 417/44.11
2003/0026701 A1 * 2/2003 Yoo et al. ..... 417/42
2003/0133807 A1 * 7/2003 Heo ..... 417/44.11
2003/0161734 A1 * 8/2003 Kim ..... 417/44.1
2004/0119434 A1 * 6/2004 Dadd ..... 318/490
2005/0137722 A1 * 6/2005 Yoo et al. ..... 700/32
2005/0158178 A1 * 7/2005 Yoo et al. ..... 417/45

FOREIGN PATENT DOCUMENTS

CN 1346937 A 5/2002
DE 102 26 491 A1 2/2003
DE 101 96 533 T5 4/2004
DE 10 2004 051 320 A1 7/2005
KR 10-2005-0082880 A 8/2005
KR 10-0533011 B1 12/2005

* cited by examiner

*Primary Examiner*—Paul Ip
(74) *Attorney, Agent, or Firm*—Birch, Stewart, Kolasch & Birch, LLP

(57) ABSTRACT

An apparatus and method are disclosed to control an operation of a reciprocating compressor capable of precisely controlling an operation (stroke) of a reciprocating compressor regardless of a parameter of an internal motor of the reciprocating compressor and a mechanical error of the reciprocating compressor. The apparatus for controlling an operation of a reciprocating compressor which determines a stroke estimate value corresponding to a point when a discharge valve of the reciprocating compressor is opened as a stroke reference value, and controls a voltage applied to the reciprocating compressor according to the determined stroke reference value.

26 Claims, 8 Drawing Sheets

APPARATUS FOR CONTROLLING OPERATION OF RECIPROCATING COMPRESSOR AND METHOD THEREOF

BACKGROUND OF THE INVENTION

1. Field of the Invention

The present invention relates to a compressor and, more particularly, to an apparatus for controlling an operation of a reciprocating compressor and its method.

2. Description of the Prior Art

In general, a reciprocating compressor (hereinafter, for simplicity, referred to as "reciprocating motor compressor"), which is operated by a linearly reciprocating electric motor without a crank shaft for converting a rotational motion to a linear motion, has less friction loss, and thus, can provide a higher compression efficiency than other compressors.

When the reciprocating motor compressor is used for a refrigerator or an air-conditioner, a compression ratio of the compressor can be varied to control the cooling capacity by varying a stroke voltage applied to the reciprocating motor of the compressor.

The conventional controlling of a reciprocating motor compressor will now be described with reference to FIG. 1.

FIG. 1 is a block diagram showing the construction of an apparatus for controlling an operation of a reciprocating compressor in accordance with a conventional art.

As shown in FIG. 1, the conventional apparatus for controlling an operation of the reciprocating compressor includes a current detector 4 for detecting a current applied to a motor (not shown) of a reciprocating compressor 6; a voltage detector 3 for detecting a voltage applied to the motor, a stroke calculator 5 for calculating a stroke estimate value of the reciprocating compressor based on the detected current and voltage values and a parameter of the motor, a comparator 1 for comparing the calculated stroke estimate value and a pre-set stroke value and outputting a difference value according to the comparison result, and a stroke controller 2 for controlling an operation (stroke) of the reciprocating compressor 6 by varying a voltage applied to the motor according to the difference value.

The operation of the apparatus for controlling the operation of the compressor will now be described.

First, the current detector 4 detects a current applied to the motor (not shown) of the reciprocating compressor 6 and outputs the detected current value to the stroke calculator 5. At this time, the voltage detector 3 detects a voltage applied to the motor and outputs the detected voltage value to the stroke calculator 5.

The stroke calculator 5 calculates a stroke estimate value (X) of the reciprocating compressor 6 by substituting detected current value, the detected voltage value and the parameter of the motor to equation (1) shown below, and applies the stroke estimate value (X) to the comparator 1.

$$X = \frac{1}{\alpha}\int (V_M - Ri - L\dot{i})dt \qquad (1)$$

wherein 'R' is a motor resistance value of the reciprocating compressor, 'L' is a motor inductance value, 'α' is a motor constant, $V_M$ is the value of the voltage applied to the motor, 'i' is the value of the current applied to the motor, and $\dot{i}$ is a time variation rate of the current applied to the motor, namely, a differential value (di/dt) of 'i'.

Thereafter, the comparator 1 compares the stroke estimate value and the pre-set stroke reference value and applies a difference value according to the comparison result to the stroke controller 2.

The stroke controller controls the stroke of the reciprocating compressor 6 by varying the voltage applied to the motor of the reciprocating compressor 6 based on the difference value.

FIG. 2 is a flow chart of a method for controlling the operation of the reciprocating compressor in accordance with the conventional art.

First, the stroke calculator 5 calculates a stroke estimate value of the reciprocating compressor 6 based on the detected current value, the detected voltage value and the parameter of the motor, and applies the calculated stroke estimate value to the comparator 1 (step S1).

The comparator 1 compares the stroke estimate value with the pre-set stroke reference value (step S2) and outputs a difference value according to the comparison result to the stroke controller 2.

If the stroke estimate value is smaller than the pre-set stroke reference value, the stroke controller 2 increases a voltage applied to the motor of the reciprocating compressor (step S3), whereas if the stroke estimate value is larger than the pre-set stroke reference value, the stroke controller 2 reduces the voltage applied to the motor of the reciprocating compressor (step S4).

However, with the conventional apparatus for controlling the operation of the reciprocating compressor, the stroke estimate value cannot be precisely calculated due to the parameter of the motor of the reciprocating compressor and a mechanical error of the reciprocating compressor, failing to precisely control the operation (stroke) of the reciprocating compressor 6.

As stated above, the apparatus and method for controlling the operation of the reciprocating compressor have such a problem that since the stroke estimate value cannot be precisely calculated due to the parameter of the motor of the reciprocating compressor and the mechanical error of the reciprocating compressor, the operation (stroke) of the reciprocating compressor cannot be precisely controlled.

U.S. Pat. No. 6,779,982 issued on Aug. 24, 2004 and U.S. Pat. No. 6,746,211 issued on Jun. 8, 2004 also disclose a conventional apparatus for controlling an operation of a reciprocating compressor.

BRIEF DESCRIPTION OF THE INVENTION

Therefore, one object of the present invention is to provide an apparatus and method for controlling an operation of a reciprocating compressor capable of precisely controlling an operation (stroke) of a reciprocating compressor regardless of a parameter of an internal motor of the reciprocating compressor and a mechanical error of the reciprocating compressor.

Another object of the present invention provides an apparatus and method for controlling an operation of a reciprocating compressor capable of precisely controlling the reciprocating compressor with a compression capacity required for a specific load.

To achieve these and other advantages and in accordance with the purpose of the present invention, as embodied and broadly described herein, there is provided an apparatus for controlling an operation of a reciprocating compressor which determines a stroke estimate value corresponding to a point when a discharge valve of the reciprocating compressor is opened as a stroke reference value, and controls a voltage applied to the reciprocating compressor according to the determined stroke reference value.

To achieve the objects, there is also provided an apparatus for controlling an operation of the reciprocating compressor including: a stroke calculator for calculating a stroke estimate value based on a value of a voltage applied to a motor of the reciprocating compressor and a value of a current applied to the motor of the reciprocating compressor; a phase difference detector for detecting a phase difference between a stroke of the reciprocating compressor and the current applied to the motor based on stroke estimate values and current values during one period; an inflection point detector for detecting an inflection point of the phase difference and outputting an inflection point detect signal; a stroke reference value corrector for determining a stroke estimate value corresponding to a point when the inflection point is generated as a stroke reference value based on the inflection point detect signal; and a stroke controller for controlling the voltage applied to the motor according to the determined stroke reference value.

To achieve the objects, there is also provided an apparatus for controlling an operation of the reciprocating compressor including: a stroke calculator for calculating a stroke estimate value based on a value of a voltage applied to a motor of the reciprocating compressor and a value of a current applied to the motor of the reciprocating compressor; a damping coefficient calculator for detecting a phase difference between a stroke of the reciprocating compressor and the current applied to the motor based on stroke estimate values and current values during one period and calculating a damping coefficient based on the phase difference, the current value and the stroke estimate value; an inflection point detector for detecting an inflection point of the damping coefficient and outputting an inflection point detect signal; a stroke reference value corrector for determining a stroke estimate value corresponding to a point when the inflection point is generated as a stroke reference value based on the inflection point detect signal; and a stroke controller for controlling the voltage applied to the motor according to the determined stroke reference value.

To achieve the objects, there is also provided an apparatus for controlling an operation of the reciprocating compressor including: a stroke calculator for calculating a stroke estimate value based on a value of a voltage applied to a motor of the reciprocating compressor and a value of a current applied to the motor of the reciprocating compressor; a gas spring constant for detecting a phase difference between a stroke of the reciprocating compressor and the current applied to the motor based on stroke estimate values and current values during one period and calculating a gas spring constant of the reciprocating compressor based on the phase difference, the current value and the stroke estimate value; an inflection point detector for detecting an inflection point of the gas spring constant and outputting an inflection point detect signal; a stroke reference value corrector for determining a stroke estimate value corresponding to a point when the inflection point is generated as a stroke reference value based on the inflection point detect signal; and a stroke controller for controlling the voltage applied to the motor according to the determined stroke reference value.

To achieve the objects, there is also provided a method for controlling an operation of the reciprocating compressor including: determining a stroke estimate value corresponding to a point when a discharge valve of the reciprocating compressor is opened as a stroke reference value; and controlling a voltage applied to the reciprocating compressor according to the determined stroke reference value.

To achieve the objects, there is also provided a method for controlling an operation of the reciprocating compressor including: calculating a stroke estimate value based on values of a voltage and a current applied to a motor of the reciprocating compressor; detecting a phase difference between a stroke of the reciprocating compressor and the current applied to the motor based on stroke estimate values and current values during one period; detecting an inflection point of the phase difference; determining a stroke estimate value corresponding to a point when the inflection point is generated as a stroke reference value; and controlling the voltage applied to the motor according to the determined stroke reference value.

To achieve the objects, there is also provided a method for controlling an operation of the reciprocating compressor including: calculating a stroke estimate value based on values of a voltage and a current applied to a motor of the reciprocating compressor; detecting a phase difference between a stroke of the reciprocating compressor and the current applied to the motor based on stroke estimate values and current values during one period; calculating a damping coefficient based on the phase difference, the value of the current and the stroke estimate value; detecting an inflection point of the damping coefficient; determining a stroke estimate value corresponding to a point when the inflection point is generated as a stroke reference value; and controlling the voltage applied to the motor according to the determined stroke reference value.

To achieve the objects, there is also provided a method for controlling an operation of the reciprocating compressor including: calculating a stroke estimate value based on values of a voltage and a current applied to a motor of the reciprocating compressor; detecting a phase difference between a stroke of the reciprocating compressor and the current applied to the motor based on stroke estimate values and current values during one period; calculating a gas spring constant of the reciprocating compressor based on the phase difference, the value of the current and the stroke estimate value; detecting an inflection point of the gas spring constant; determining a stroke estimate value corresponding to a point when the inflection point is generated as a stroke reference value; and controlling the voltage applied to the motor according to the determined stroke reference value.

To achieve the objects, there is also provided a method for controlling an operation of the reciprocating compressor including: detecting a phase difference between a stroke of the reciprocating compressor and a current applied to the reciprocating compressor; determining a stroke estimate value corresponding to a point when an inflection point of the phase difference is generated as a stroke reference value; and controlling a voltage applied to the reciprocating compressors according to the determined stroke reference value.

To achieve the objects, there is also provided a method for controlling an operation of the reciprocating compressor including: detecting a phase difference between a stroke of the reciprocating compressor and a current applied to the reciprocating compressor; calculating a damping coefficient based on the phase difference, a value of a current applied to the reciprocating compressor and a stroke estimate value of the reciprocating compressor; determining a stroke estimate value corresponding to a point when an inflection point of the damping coefficient is generated as a stroke reference value; and controlling a voltage applied to the reciprocating compressors according to the determined stroke reference value.

To achieve the objects, there is also provided a method for controlling an operation of the reciprocating compressor including: detecting a phase difference between a stroke of the reciprocating compressor and a current applied to the reciprocating compressor; calculating a gas spring constant of the reciprocating compressor based on the phase difference, a value of a current applied to the reciprocating compressor and a stroke estimate value of the reciprocating compressor; determining a stroke estimate value corresponding to a point when an inflection point of the gas spring constant is generated as a stroke reference value; and controlling a voltage applied to the reciprocating compressors according to the determined stroke reference value.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

An apparatus and method for controlling an operation of a reciprocating compressor capable of precisely controlling an operation (stroke) of a reciprocating compressor regardless of a parameter of an internal motor of the reciprocating compressor and a mechanical error of the reciprocating compressor by determining a stroke estimate value corresponding to a point when a discharge value of the reciprocating compressor is opened as a stroke reference value and controlling a voltage applied to the reciprocating compressor according to the determined stroke reference value, in accordance with preferred embodiments of the present invention will now be described with reference to FIGS. 3 to 11.

Figure 1:
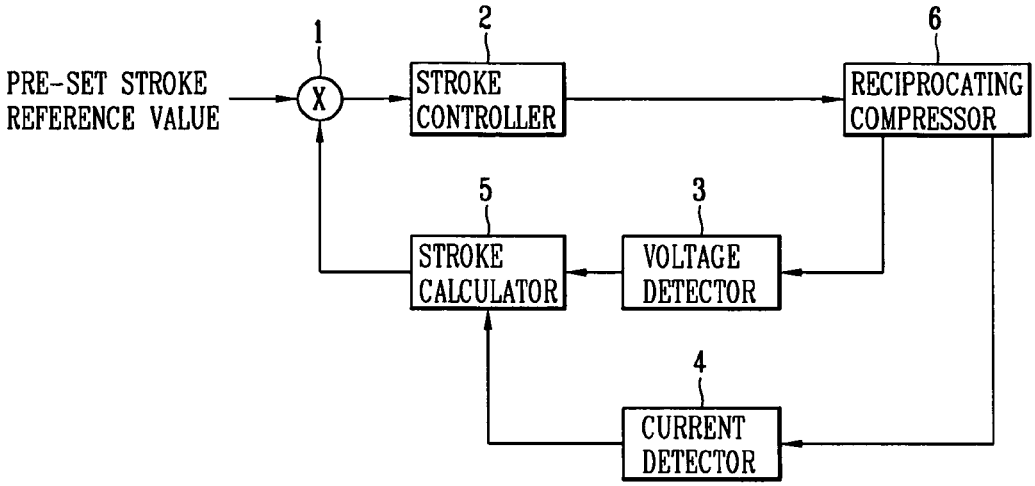
FIG. 1 PRIOR ART
FIG. 1 is a block diagram showing the construction of an apparatus for controlling an operation of a reciprocating compressor in accordance with a conventional art.
Figure 2:
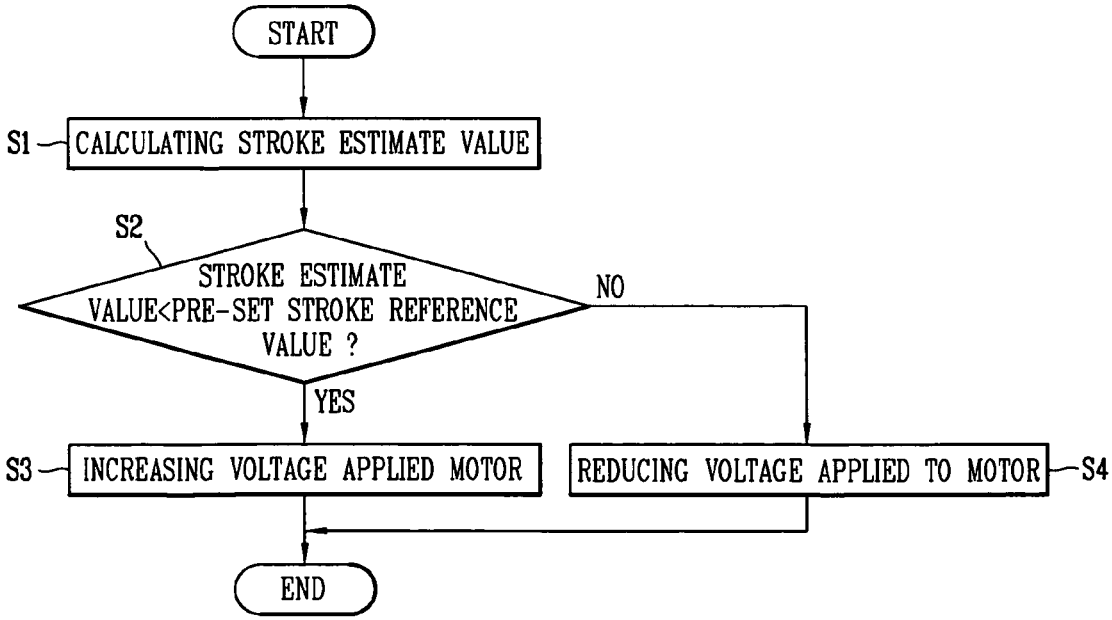
FIG. 2 PRIOR ART
FIG. 2 is a flow chart of a method for controlling the operation of the reciprocating compressor in accordance with the conventional art.
Figure 3:
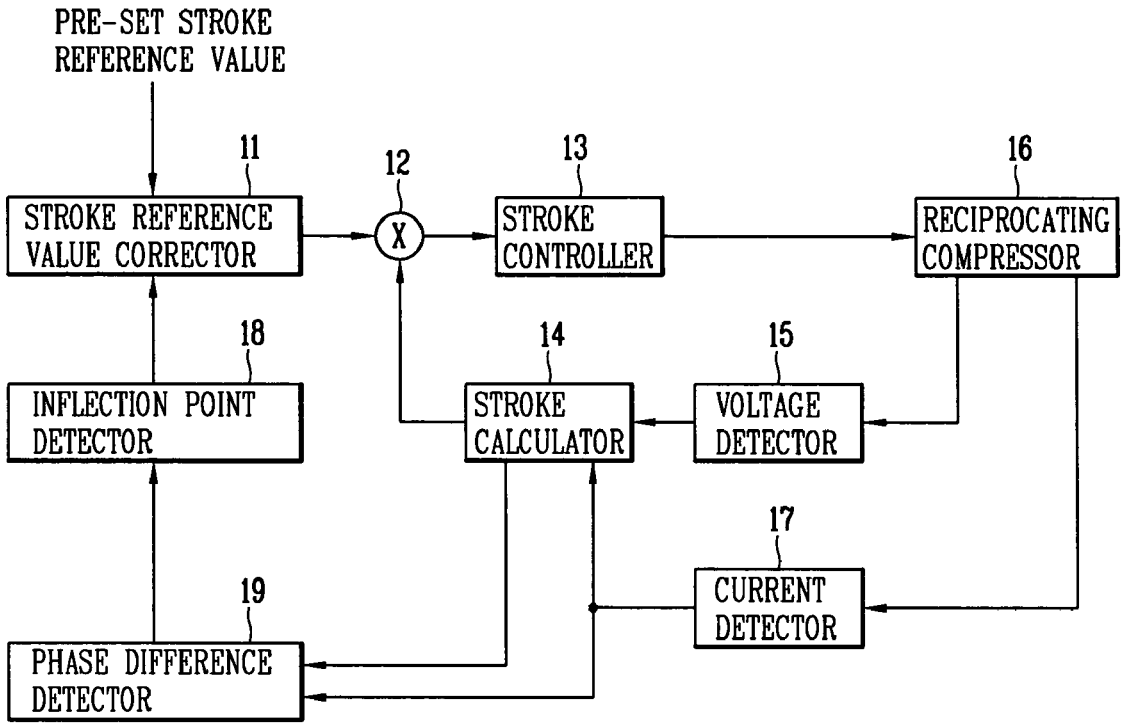
FIG. 3 is a block diagram showing the construction of an apparatus for controlling an operation of a reciprocating compressor in accordance with a first embodiment of the present invention.

FIG. 3 is a block diagram showing the construction of an apparatus for controlling an operation of a reciprocating compressor in accordance with a first embodiment of the present invention.

As shown in FIG. 3, an apparatus for controlling an operation of the reciprocating compressor in accordance with the first embodiment of the present invention includes: a current detector 17 for detecting a current applied to a motor (not shown) of a reciprocating compressor 16; a voltage detector 15 for detecting a voltage applied to the motor; a stroke calculator 14 for calculating a stroke estimate value of the reciprocating compressor 16 based on the detected current and voltage values and a parameter of the motor; comparator 12 for comparing the stroke estimate value and a stroke reference value, and outputting a difference value according to the comparison result; a stroke controller 13 for controlling an operation (stroke) of the reciprocating compressor 16 by varying the voltage applied to the motor according to the difference value; a phase difference detector 19 for detecting a phase difference between the stroke and the current of the reciprocating compressor 16 based on stroke estimate values and current values during one period; an inflection point detector 18 for detecting an inflection point of the phase difference and outputting an inflection point detect signal; and a stroke reference value corrector 11 for determining a stroke estimate value corresponding to a point when the inflection point is detected based on the inflection point detect signal outputted from the inflection point detector 18 as a stroke reference value, and outputting the determined stroke reference value to the comparator 12. Herein the inflection point means a point at which the phase difference between the stroke and the current increases after having been reduced, namely, a point at which a slope is changed. The stroke means a position of a piston (not shown) of the reciprocating compressor when the piston is reciprocally moved.

The operation of the apparatus for controlling the operation of the reciprocating compressor in accordance with the first embodiment of the present invention will now be described in detail.

First, the current detector 17 detects a current applied to the motor of the reciprocating compressor 16, and outputs the detected current value to the stroke calculator 14 and the phase difference detector 19. At this time, the voltage detector 15 detects a voltage applied to the motor of the reciprocating compressor 16 and outputs the detected voltage value to the stroke calculator 14.

The stroke calculator 14 calculates a stroke estimate value of the reciprocating compressor 16 based on the current and voltage values and a parameter of the motor, and applies the calculated stroke estimate value to the comparator 12.

The comparator 12 compares the stroke estimate value with the stroke reference value and applies a difference value according to the comparison result to the stroke controller 13.

Then, the stroke controller 13 controls the stroke of the reciprocating compressor by varying the voltage applied to the motor. Herein, the stroke reference value is a stroke estimate value corresponding to a point when an inflection point of the phase difference between the stroke and the current is generated.

Namely, the stroke reference value means a point when a discharge value of the reciprocating compressor is opened. Accordingly, the operation (stroke) of the reciprocating compressor can be precisely controlled by detecting a stroke phase based on the stroke estimate values during one period, detecting a phase of a current based on current values during one period, detecting the inflection point of the detected phase difference between the stroke and the current, recognizing the stroke estimate value (stroke reference value) corresponding to the point when the inflection point is generated as the point when the discharge valve is opened, and changing the pre-set stroke reference value to the stroke estimate value (stroke reference value).

The method for detecting the inflection point of the phase difference between the stroke and the current will now be described in detail. Herein, there can be various embodiments implemented by a person skilled in the art for the method for detecting the inflection point of the phase difference between the stroke and the current, and one of those embodiments will be described in detail with reference to FIGS. 4 to 6.

First, the phase difference detector 19 detects a phase of a stroke based on stroke estimate values corresponding to one period, detects phase of a current based on current values corresponding to one period, a phase difference between the stroke and the current, and outputs the detected phase difference to the inflection point detector 18. For example, the phase difference detector 19 calculates an angle between a mean value of stroke estimate values smaller than '0' and a mean value of current values smaller than '0' to detect the phase difference.

Figure 4:
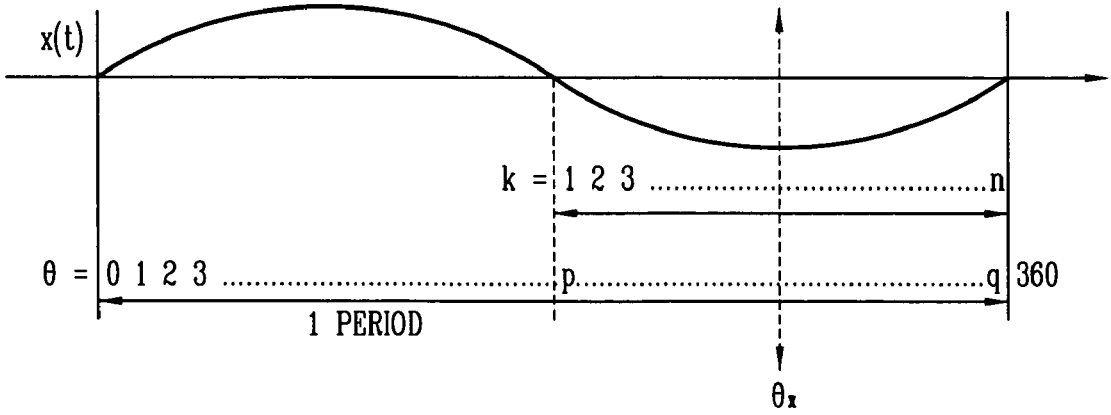
FIG. 4 is a graph showing a method for detecting a stroke phase in accordance with the present invention.

FIG. 4 is a graph showing a method for detecting a stroke phase in accordance with the present invention.

As shown in FIG. 4, θ has numbers of 0~360 from a start point to an end point of one period. However, θ corresponding to stroke estimate values smaller than '0' has the number of p~q and the number (k) thereof is 'k'. Herein, in order to have characteristics resistant to noise, it is preferred to calculate not a middle value but a mean value. Accordingly, the stroke phase ($\theta_x$) is calculated by equation (2) shown below:

$$\theta_x = \frac{1}{n}\sum_{j=p}^{q} j \tag{2}$$

Figure 5:
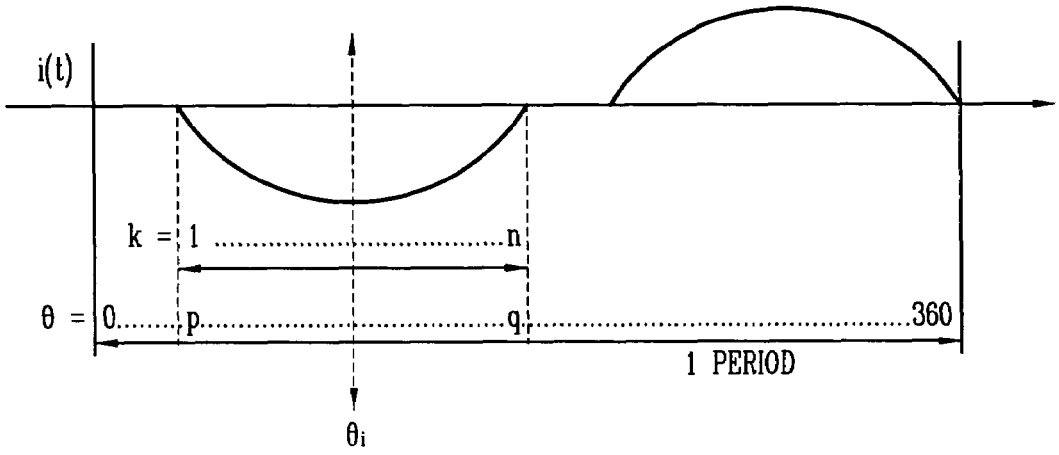
FIG. 5 is a graph showing a method for detecting a current phase in accordance with the present invention.

FIG. 5 is a graph showing a method for detecting a current phase in accordance with the present invention.

As shown in FIG. 5, θ corresponding to values smaller than '0' has the number of p~q and its number (k) is 'n'. Accordingly, a current phase ($\theta_i$) is calculated by equation (3) shown below:

$$\theta_i = \frac{1}{n}\sum_{j=p}^{q} j \tag{3}$$

Figure 6:
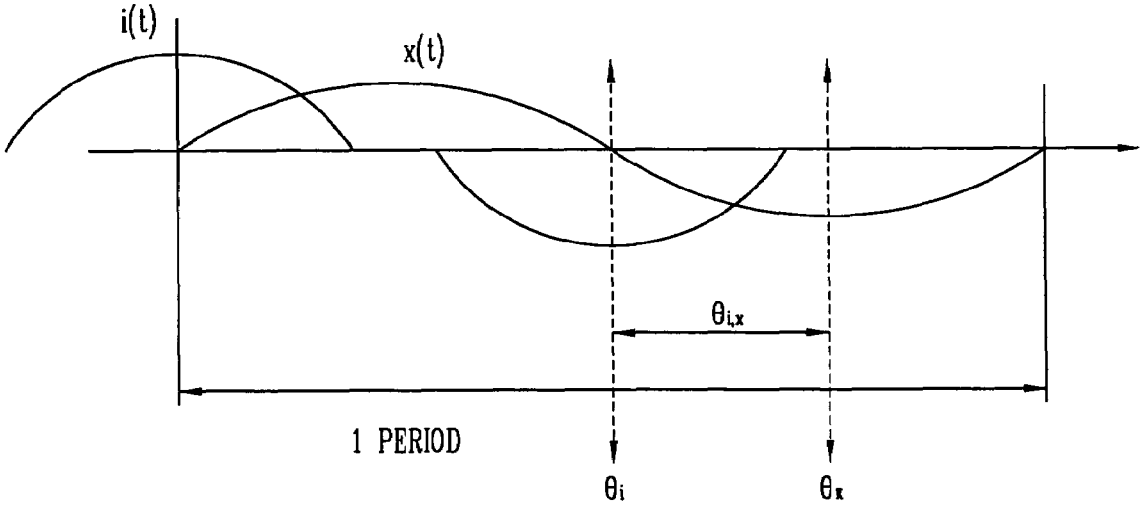
FIG. 6 is a graph showing a method for calculating a phase difference between a stroke and a current.

FIG. 6 is a graph showing a method for calculating a phase difference between a stroke and a current.

As shown in FIG. 6, the phase difference detector 19 detects a phase difference (θi,x) between a stroke and a current by calculating an angle between a mean value of stroke estimate values smaller than '0' and a mean value of current values smaller than '0'

Thereafter, the inflection point detector 18 detects an inflection point (a point at which the phase difference between the stroke and the current increases after having been reduced) of the phase difference between the stroke and the current and outputs an inflection point detect signal to the stroke reference value corrector 11.

The stroke reference value corrector 11 corrects the pre-set stroke reference value based on the inflection point detect signal outputted from the inflection point detector 18. Namely, the stroke reference value corrector 11 determines a stroke estimate value corresponding to a point at which the inflection point of the detected phase difference between the current and the stroke is generated as a stroke reference value, and applies the determined stroke reference value to the comparator 12. For example, the stroke reference value corrector 11 reads a correction value used for changing the pre-set stroke reference value to the determined stroke reference value from a storage unit (not shown), adds the read correction value to the pre-set stroke reference value, and outputs the added value (stroke reference value) to the comparator 12.

Meanwhile, if an inflection point of the detected phase difference between the current and the stroke is not generated, preferably, the stroke reference value corrector 11 applies a previously defined stroke reference value to the comparator 12 or applies the pre-set stroke reference value to the comparator 12.

The method for controlling the operation of the reciprocating compressor in accordance with a first embodiment of the present invention will now be described in detail with reference to FIGS. 3 to 7.

Figure 7:
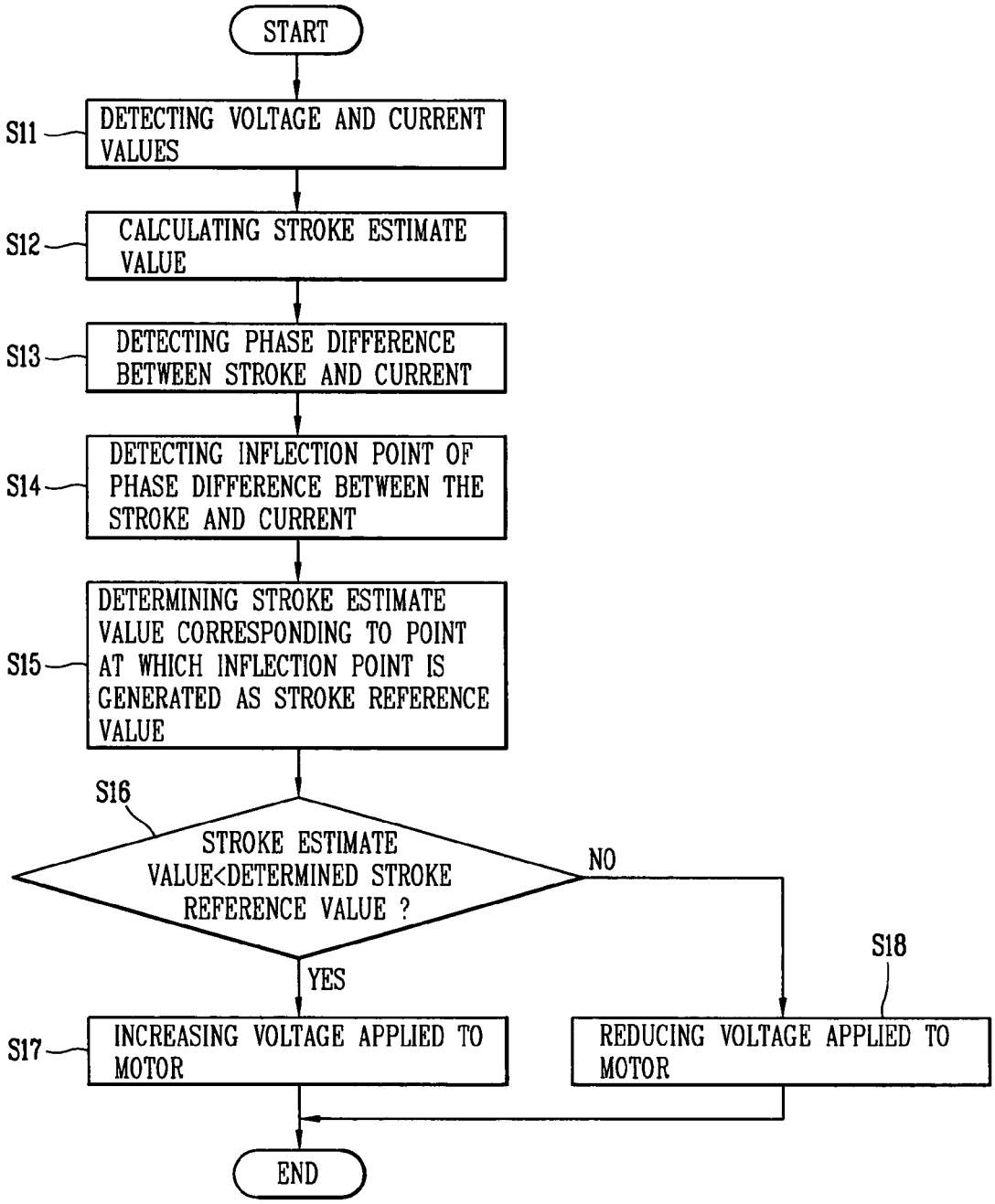
FIG. 7 is a flow chart of a method for controlling the operation of the reciprocating compressor in accordance with the first embodiment of the present invention.

FIG. 7 is a flow chart of a method for controlling the operation of the reciprocating compressor in accordance with the first embodiment of the present invention.

First, the current detector 17 detects a current applied to the motor of the reciprocating compressor 16 and outputs the detected current value to the stroke calculator 14 and the phase difference detector 19. At this time, the voltage detector 15 detects a voltage applied to the motor of the reciprocating compressor 16 and outputs the detected voltage value to the stroke calculator 14 (step S11).

The stroke calculator 14 calculates a stroke estimate value based on the current and voltage values and a parameter of the motor, and applies the calculated stroke estimate value to the phase difference detector 19 (step S12).

The phase difference detector 19 detects a phase of a stroke based on stroke estimate values corresponding to one period, detects a phase of a current based on current values corresponding to one period, detects a phase difference between the stroke and the current, and outputs the detected phase difference to the inflection point detector 18 (step S13).

The inflection point detector 18 detects an inflection point of the phase difference between the stroke estimate value and the current to generate an inflection point detect signal, and outputs the inflection point detect signal to the stroke reference value corrector 11 (step S14).

The stroke reference value corrector 11 receives the inflection point detect signal from the inflection point detector 18, and corrects the pre-set stroke reference value based on the received inflection point detect signal. Namely, the stroke reference value corrector 11 determines a stroke estimate value corresponding to a point at which an inflection point of the detected phase difference between the current and the stroke is generated as a stroke reference value, and applies the determined stroke reference value to the comparator 12 (step S15).

Meanwhile, if an inflection point of the detected phase difference between the current and the stroke is not generated, the stroke reference value corrector 11 applies a pre-set stroke reference value to the comparator 12, or if there is a previously determined stroke reference value, the stroke reference value corrector 11 applies the previously determined stroke reference value to the comparator 12.

The comparator 12 compares the stroke estimate value and the pre-defined stroke reference value and applies a difference value according to the comparison result to the stroke controller 13 (step S16).

If the stroke estimate value is smaller than the pre-defined stroke reference value based on the difference value, the stroke controller 13 increases a voltage applied to a motor of the reciprocating compressor (step S17). If, however, the stroke estimate value is larger than the pre-defined stroke reference value based on the difference value, the stroke controller 13 reduces a voltage applied to a motor of the reciprocating compressor (step S18).

Thus, according to the apparatus and method for controlling the operation of the reciprocating compressor in accordance with the present invention, the operation (stroke) of the reciprocating compressor can be precisely controlled regardless of a parameter of the internal motor of the reciprocating compressor and a mechanical error of the reciprocating compressor by detecting the phase difference between the stroke and the current based on the stroke estimate values of the reciprocating compressor and the current values applied to the reciprocating compressor, recognizing the stroke estimate value corresponding to the point at which the inflection point of the phase difference is generated as a point at which a discharge valve of the reciprocating compressor is opened, and determining the stroke estimate value as the stroke reference value.

In addition, according to the apparatus and method for controlling the operation of the reciprocating compressor in accordance with the present invention, by controlling the stroke of the reciprocating compressor according to the stroke estimate value corresponding to the point at which the inflection point of the phase difference is generated, a compression capacity of the reciprocating compressor can be uniformly increased according to a load when the load is increased, and the compression capacity of the reciprocating compressor can be uniformly reduced when the load becomes small. Accordingly, the reciprocating compressor can be precisely controlled with a compression capacity required for a particular load.

Figure 8:
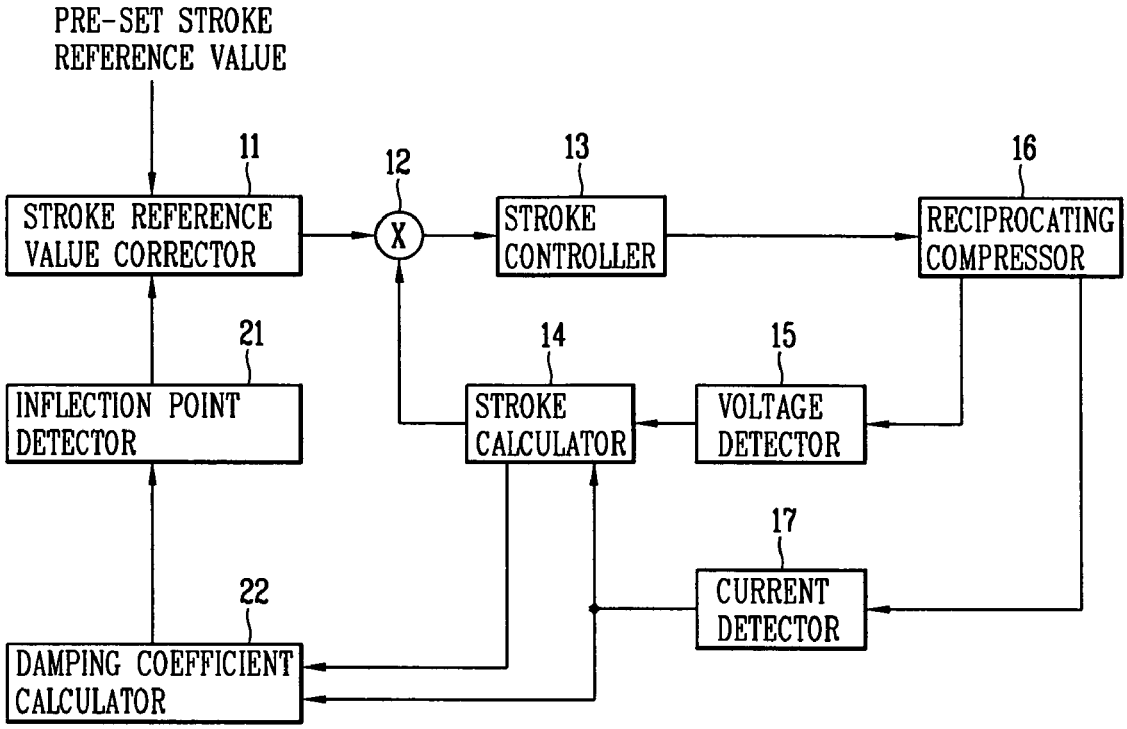
FIG. 8 is a block diagram showing the construction of an apparatus for controlling an operation of a reciprocating compressor in accordance with a second embodiment of the present invention.

FIG. 8 is a block diagram showing the construction of an apparatus for controlling an operation of a reciprocating compressor in accordance with a second embodiment of the present invention.

As shown in FIG. 8, an apparatus for controlling an operation of the reciprocating compressor in accordance with the second embodiment of the present invention includes: a current detector 17 for detecting a current applied to a motor (not shown) of a reciprocating compressor 16; a voltage detector 15 for detecting a voltage applied to the motor; a stroke calculator 14 for calculating a stroke estimate value of the reciprocating compressor 16 based on the detected current and voltage values and a parameter of the motor; comparator 12 for comparing the stroke estimate value and a stroke reference value, and outputting a difference value according to the comparison result; a stroke controller 13 for controlling an operation (stroke) of the reciprocating compressor 16 by varying the voltage applied to the motor according to the difference value; a damping coefficient calculator 22 for calculating a damping coefficient based on a phase difference between the stroke and the current, the current value and the stroke estimate value; an inflection point detector 21 for detecting an inflection point of the damping coefficient outputted from the damping coefficient calculator 22 and generating an inflection point detect signal; and a stroke reference value corrector 11 for determining a stroke estimate value corresponding to a point when the inflection point is detected based on the inflection point detect signal outputted from the inflection point detector 18 as a stroke reference value, and outputting the determined stroke reference value to the comparator 12. Herein, the determined stroke reference value means a point at which a discharge valve of the reciprocating compressor is opened, and the inflection point is a point at which the damping coefficient increases after having been reduced, namely, a point at which a slope is changed.

The operation of the apparatus for controlling the operation of the reciprocating compressor in accordance with the second embodiment of the present invention will now be described with reference to FIGS. 8 and 9.

Figure 9:
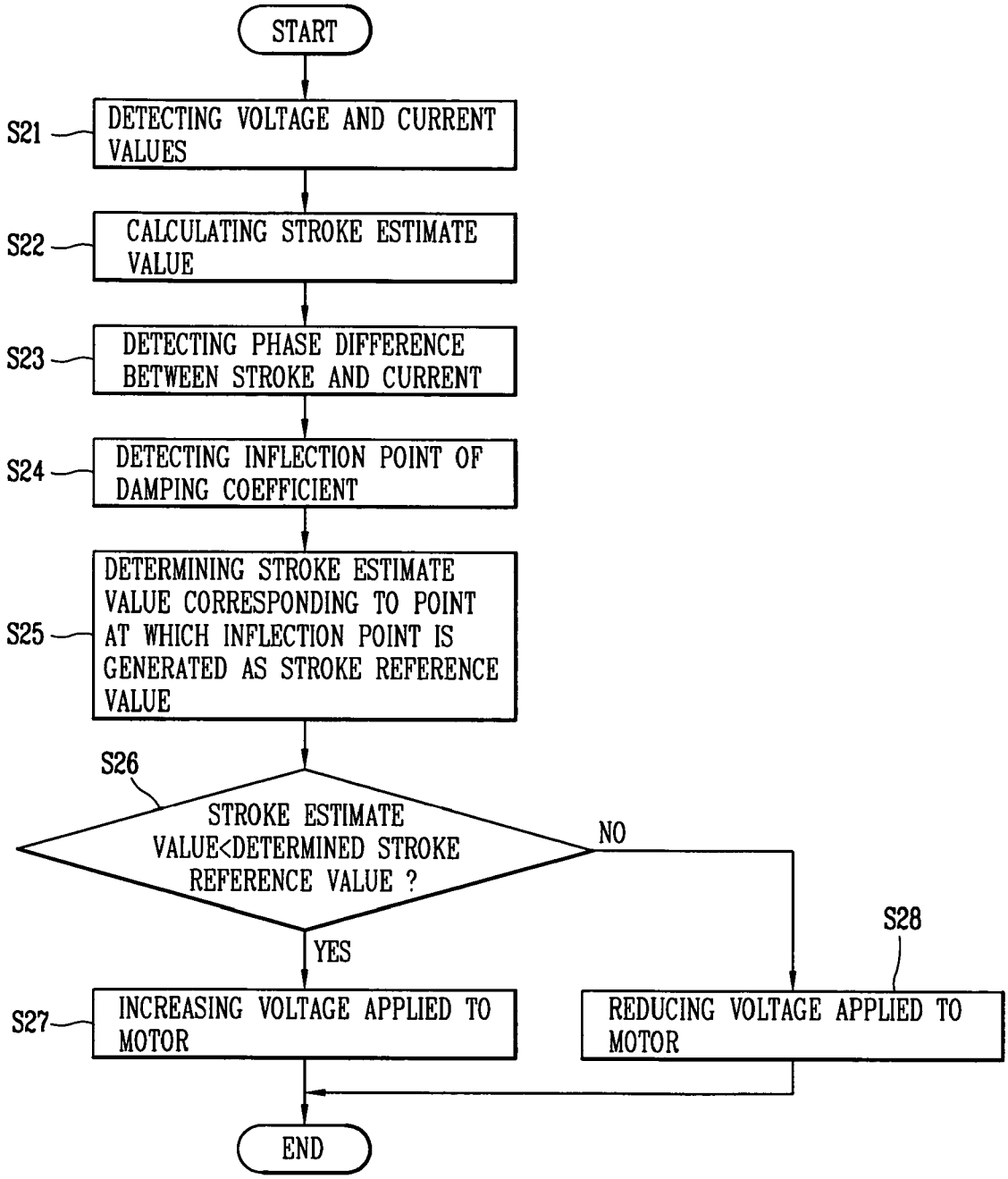
FIG. 9 is a flow chart of a method for controlling the operation of the reciprocating compressor in accordance with the second embodiment of the present invention.

FIG. 9 is a flow chart of a method for controlling the operation of the reciprocating compressor in accordance with the second embodiment of the present invention.

First, the current detector 17 detects a current applied to the motor of the reciprocating compressor 16, and outputs the detected current value to the stroke calculator 14 and the damping coefficient calculator 22. At this time, the voltage detector 15 detects a voltage applied to the motor of the reciprocating compressor 16 and outputs the detected voltage value to the stroke calculator 14 (step S21).

The stroke calculator 14 calculates a stroke estimate value based on the current and voltage values and a parameter of the motor, and applies the calculated stroke estimate value to the damping coefficient calculator 22 (step S22).

The damping coefficient calculator 22 detects a phase of a stroke based on stroke estimate values corresponding to one period, detects phase of a current based on current values corresponding to one period, detects a phase difference between the stroke and the current (step S23), calculates a damping coefficient based on the detected phase difference, the current value, the stroke estimate value, and outputs the damping coefficient to the inflection point detector 21. Herein, the method for detecting the phase difference has been described in detail in the first embodiment, so its explanation will be omitted.

The damping coefficient calculator 22 calculates the damping coefficient (C) by using equation (4) shown below:

$$C = \frac{\alpha}{\omega} x \left| \frac{I(jw)}{X(jw)} \right| x \sin(\theta_{i,x}) \tag{4}$$

wherein, 'α' is a motor constant of the reciprocating compressor, ω is 2πf ('f' is an operation frequency), I(jw) is a current peak value of one period, X(jw) is a stroke peak value of one period, and $\theta_{i,x}$ means a phase difference between a current and a stroke.

The inflection point detector 21 generates an inflection point detect signal by detecting an inflection point (at which the damping coefficient increases after having been reduced) of the damping coefficient (C), and outputs the inflection point detect signal to the stroke reference value corrector 11 (step S24).

The stroke reference value corrector 11 corrects the pre-set stroke reference value based on the inflection point detect signal outputted from the inflection point detector 21. Namely, the stroke reference value corrector 11 determines a stroke estimate value corresponding to a point at which the inflection point of the damping coefficient is generated as a stroke reference value, and applies the determined stroke reference value to the comparator 12. For example, the stroke reference value corrector 11 reads a correction value used for changing the pre-set stroke reference value to the determined stroke reference value from a storage unit (not shown), adds the read correction value to the pre-set stroke reference value, and outputs the added value (stroke reference value) to the comparator 12 (step S25).

The comparator 12 compares the stroke estimate value and the pre-defined stroke reference value and applies a difference value according to the comparison result to the stroke controller 13 (step S26).

If the stroke estimate value is smaller than the pre-defined stroke reference value based on the difference value, the stroke controller 13 increases a voltage applied to a motor of the reciprocating compressor (step S27). If, however, the stroke estimate value is larger than the pre-defined stroke reference value based on the difference value, the stroke controller 13 reduces a voltage applied to a motor of the reciprocating compressor (step S28).

Meanwhile, if an inflection point of the damping coefficient is not generated, the stroke reference value corrector 11 applies a pre-set stroke reference value to the comparator 12, or if there is a previously determined stroke reference value, the stroke reference value corrector 11 applies the previously determined stroke reference value to the comparator 12.

Thus, according to the apparatus and method for controlling the operation of the reciprocating compressor in accordance with the present invention, the operation (stroke) of the reciprocating compressor can be precisely controlled regardless of a parameter of the internal motor of the reciprocating compressor and a mechanical error of the reciprocating compressor by detecting the phase difference between the stroke and the current based on the stroke estimate values of the reciprocating compressor and the current values applied to the reciprocating compressor, calculating the damping coefficient based on the phase difference, the current value and the stroke estimate value, recognizing the stroke estimate value corresponding to the point at which the inflection point of the damping coefficient is generated as a point at which a discharge valve of the reciprocating compressor is opened, and determining the stroke estimate value as the stroke reference value.

In addition, according to the apparatus and method for controlling the operation of the reciprocating compressor in accordance with the present invention, by controlling the stroke of the reciprocating compressor according to the stroke estimate value corresponding to the point at which the inflection point of the damping coefficient is generated, a compression capacity of the reciprocating compressor can be uniformly increased according to a load when the load is increased, and the compression capacity of the reciprocating compressor can be uniformly reduced when the load becomes small. Accordingly, the reciprocating compressor can be precisely controlled with a compression capacity required for a particular load.

Figure 10:
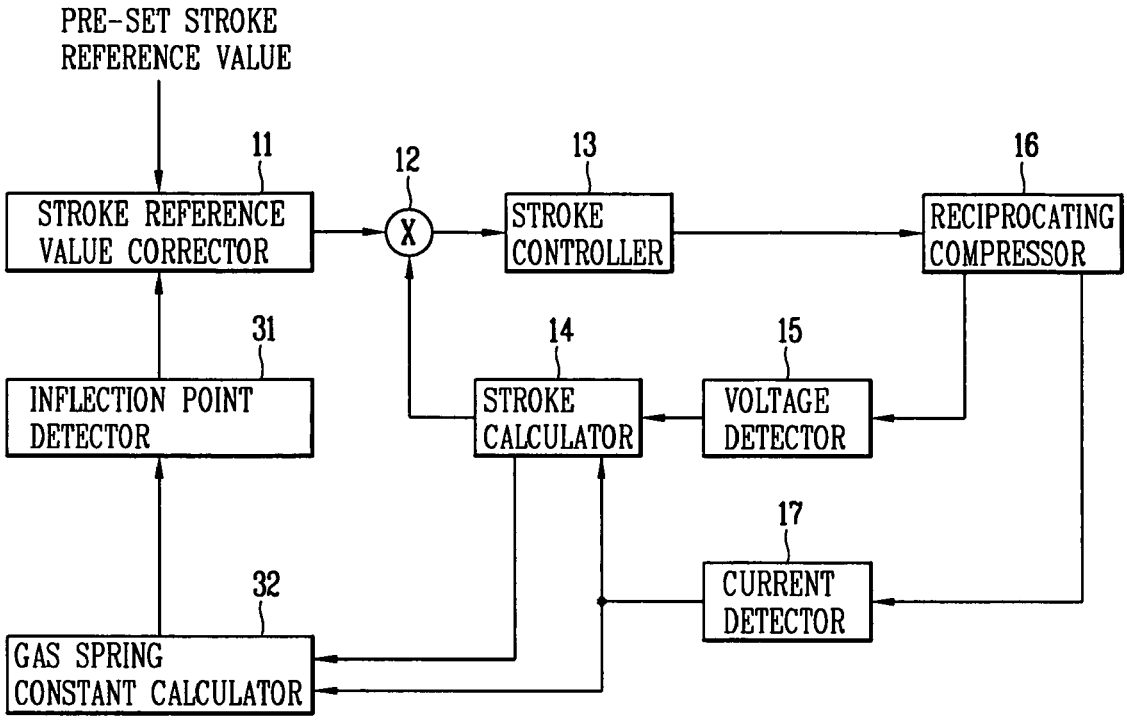
FIG. 10 is a block diagram showing the construction of an apparatus for controlling an operation of a reciprocating compressor in accordance with a third embodiment of the present invention.

FIG. 10 is a block diagram showing the construction of an apparatus for controlling an operation of a reciprocating compressor in accordance with a third embodiment of the present invention.

As shown in FIG. 10, an apparatus for controlling an operation of the reciprocating compressor in accordance with the third embodiment of the present invention includes: a current detector 17 for detecting a current applied to a motor (not shown) of a reciprocating compressor 16; a voltage detector 15 for detecting a voltage applied to the motor; a stroke calculator 14 for calculating a stroke estimate value of the reciprocating compressor 16 based on the detected current and voltage values and a parameter of the motor; comparator 12 for comparing the stroke estimate value and a stroke reference value, and outputting a difference value according to the comparison result; a stroke controller 13 for controlling an operation (stroke) of the reciprocating compressor 16 by varying the voltage applied to the motor according to the difference value; a gas spring constant calculator 32 for calculating a gas spring constant ($K_g$) of the reciprocating compressor based on a phase difference between the stroke and the current, the current value and the stroke estimate value; an inflection point detector 31 for detecting an inflection point of the gas spring constant outputted from the damping coefficient calculator 22 and generating an inflection point detect signal; and a stroke reference value corrector 11 for determining a stroke estimate value corresponding to a point when the inflection point is detected based on the inflection point detect signal outputted from the inflection point detector 18 as a stroke reference value, and outputting the determined stroke reference value to the comparator 12. Herein, the determined stroke reference value means a point at which a discharge valve of the reciprocating compressor is opened, and the inflection point is a point at which the gas spring constant increases after having been reduced, namely, a point at which a slope is changed.

The operation of the apparatus for controlling the operation of the reciprocating compressor in accordance with the third embodiment of the present invention will now be described with reference to FIGS. 10 and 11.

Figure 11:
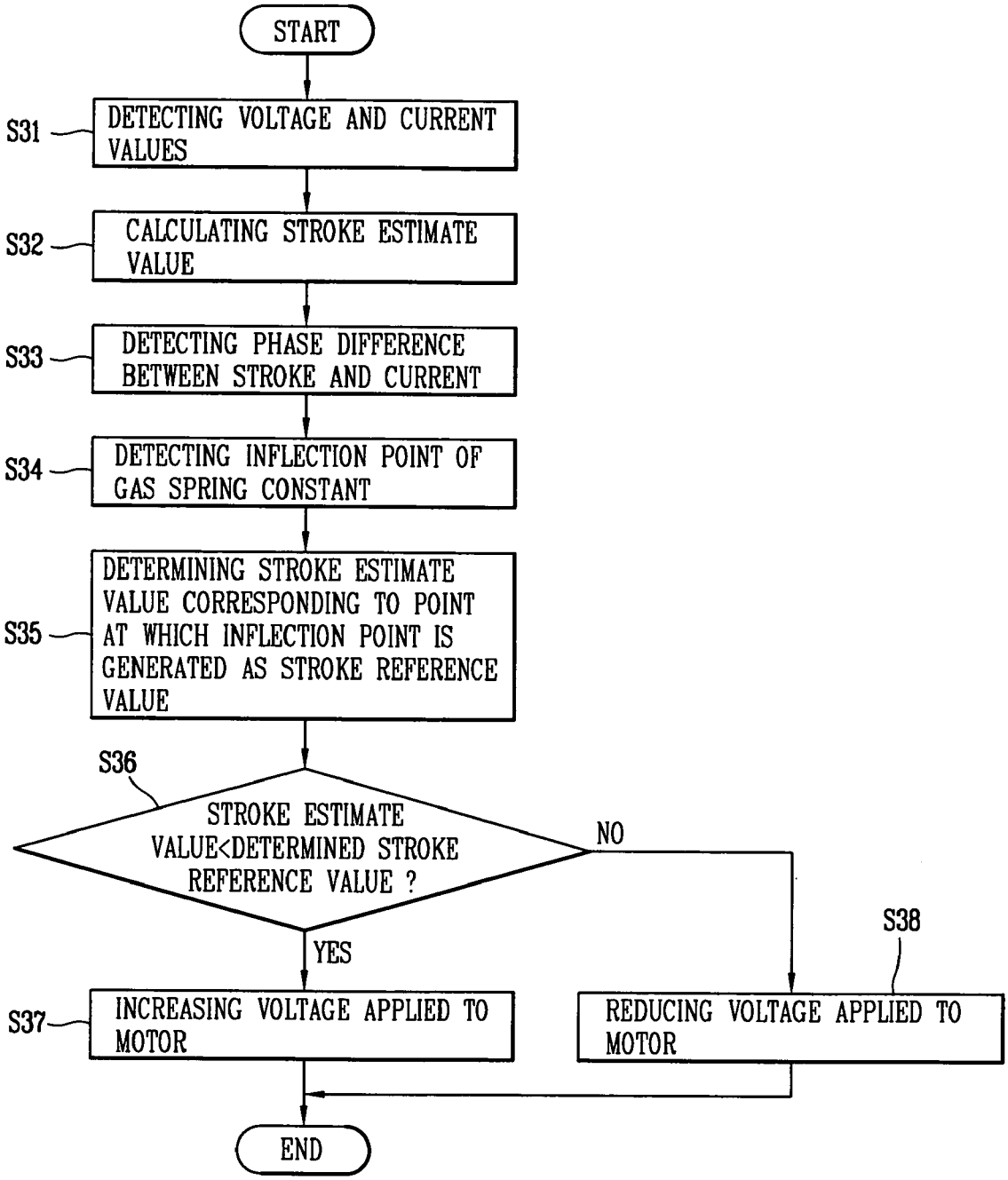
FIG. 11 is a flow chart of a method for controlling the operation of the reciprocating compressor in accordance with the third embodiment of the present invention.

FIG. 11 is a flow chart of a method for controlling the operation of the reciprocating compressor in accordance with the third embodiment of the present invention.

First, the current detector 17 detects a current applied to the motor of the reciprocating compressor 16, and outputs the detected current value to the stroke calculator 14 and the gas spring constant calculator 32. At this time, the voltage detector 15 detects a voltage applied to the motor of the reciprocating compressor 16 and outputs the detected voltage value to the stroke calculator 14 (step S31).

The stroke calculator 14 calculates a stroke estimate value based on the current and voltage values and a parameter of the motor, and applies the calculated stroke estimate value to the gas spring constant calculator 32 (step S32).

The gas spring constant calculator 32 detects a phase of a stroke based on stroke estimate values corresponding to one period, detects phase of a current based on current values corresponding to one period, detects a phase difference between the stroke and the current (step S33), calculates a gas spring constant based on the detected phase difference, the current value, the stroke estimate value, and outputs the gas spring constant to the inflection point detector 31. Herein, the method for detecting the phase difference has been described in detail in the first embodiment, so its explanation will be omitted.

The gas spring constant calculator 32 calculates the gas spring constant ($K_g$) by using equation (5) shown below:

$$k_g = \alpha x \left| \frac{I(jw)}{X(jw)} \right| x\cos(\theta_{i,x}) + M\omega^2 - K_m \tag{5}$$

wherein, '$\alpha$' is a motor constant of the reciprocating compressor, I(jw) is a current peak value of one period, X(jw) is a stroke peak value of one period, $\theta_{i,x}$ means a phase difference between a current and a stroke, 'M' is a piston moving mass of the reciprocating compressor, $\omega$ is $2\pi f$ ('f' is an operation frequency), and $K_m$ is a machine spring constant of the reciprocating compressor.

The inflection point detector 31 detects the inflection point (at which the gas spring constant increases after having been reduced) of the gas spring constant ($K_g$), and outputs the inflection point detect signal to the stroke reference value corrector 11 (step S34).

The stroke reference value corrector 11 corrects the pre-set stroke reference value based on the inflection point detect signal outputted from the inflection point detector 31. Namely, the stroke reference value corrector 11 determines a stroke estimate value corresponding to a point at which the inflection point of the gas spring constant is generated as a stroke reference value, and applies the determined stroke reference value to the comparator 12. For example, the stroke reference value corrector 11 reads a correction value used for changing the pre-set stroke reference value to the determined stroke reference value from a storage unit (not shown), adds the read correction value to the pre-set stroke reference value, and outputs the added value (stroke reference value) to the comparator 12 (step S35).

The comparator 12 compares the stroke estimate value and the pre-defined stroke reference value and applies a difference value according to the comparison result to the stroke controller 13 (step S36).

If the stroke estimate value is smaller than the pre-defined stroke reference value based on the difference value, the stroke controller 13 increases a voltage applied to a motor of the reciprocating compressor (step S37). If, however, the stroke estimate value is larger than the pre-defined stroke reference value based on the difference value, the stroke controller 13 reduces a voltage applied to a motor of the reciprocating compressor (step S38).

Meanwhile, if an inflection point of the gas spring constant is not generated, the stroke reference value corrector 11 applies a pre-set stroke reference value to the comparator 12, or if there is a previously determined stroke reference value, the stroke reference value corrector 11 applies the previously determined stroke reference value to the comparator 12.

Thus, according to the apparatus and method for controlling the operation of the reciprocating compressor in accordance with the present invention, the operation (stroke) of the reciprocating compressor can be precisely controlled regardless of a parameter of the internal motor of the reciprocating compressor and a mechanical error of the reciprocating compressor by detecting the phase difference between the stroke and the current based on the stroke estimate values of the reciprocating compressor and the current values applied to the reciprocating compressor, calculating the damping coefficient based on the phase difference, the current value and the stroke estimate value, recognizing the stroke estimate value corresponding to the point at which the inflection point of the gas spring constant is generated as a point at which a discharge valve of the reciprocating compressor is opened, and determining the stroke estimate value as the stroke reference value.

In addition, according to the apparatus and method for controlling the operation of the reciprocating compressor in accordance with the present invention, by controlling the stroke of the reciprocating compressor according to the stroke estimate value corresponding to the point at which the inflection point of the gas spring constant is generated, a compression capacity of the reciprocating compressor can be uniformly increased according to a load when the load is increased, and the compression capacity of the reciprocating compressor can be uniformly reduced when the load becomes small. Accordingly, the reciprocating compressor can be precisely controlled with a compression capacity required for a particular load.

As so far described, the apparatus and method for controlling the operation of the reciprocating compressor in accordance with the present invention have many advantages.

That is, for example, first, by determining the stroke estimate value corresponding to the point at which the discharge valve of the reciprocating compressor is opened as the stroke reference value and controlling the voltage applied to the reciprocating compressor according to the determined stroke reference value, the operation (stroke) of the reciprocating compressor can be precisely controlled regardless of the parameter of the internal motor and the component error of the reciprocating processor.

Second, by detecting the phase difference between the stroke and the current based on the stroke estimate values of the reciprocating compressor and the current values applied to the reciprocating compressor and controlling the stroke of the reciprocating compressor based on the stroke estimate value corresponding to the point at which the inflection point of the phase difference is generated, the operation (stroke) of the reciprocating compressor can be precisely controlled regardless of the parameter of the internal motor and the component error of the reciprocating processor.

Third, the reciprocating compressor can be precisely controlled with a compression capacity required for a particular load based on the stroke estimate value corresponding to the point at which the inflection point of the phase difference is generated.

Fourth, by controlling the stroke of the reciprocating compressor based on the stroke estimate value corresponding to the point at which the inflection point of the damping coefficient is generated, the operation (stroke) of the reciprocating compressor can be precisely controlled regardless of the parameter of the internal motor and the component error of the reciprocating processor.

Fifth, the reciprocating compressor can be precisely controlled with a compression capacity required for a particular load based on the stroke estimate value corresponding to the point at which the inflection point of the damping coefficient is generated.

Sixth, by controlling the stroke of the reciprocating compressor based on the stroke estimate value corresponding to the point at which the inflection point of the gas spring constant is generated, the operation (stroke) of the reciprocating compressor can be precisely controlled regardless of the parameter of the internal motor and the component error of the reciprocating processor.

Seventh, the reciprocating compressor can be precisely controlled with a compression capacity required for a particular load based on the stroke estimate value corresponding to the point at which the inflection point of the gas spring constant is generated.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for controlling an operation of a reciprocating compressor which determines a stroke estimate value corresponding to a point when a discharge valve of the reciprocating compressor is opened as a stroke reference value, and controls a voltage applied to the reciprocating compressor according to determined stroke reference value, the apparatus comprising:

a stroke calculator configured to calculate a stroke estimate value based on a value of a voltage applied to a motor of the reciprocating compressor and a value of a current applied to the motor of the reciprocating compressor;

an inflection point detector configured to detect an inflection point based on a phase difference between a stroke of the reciprocating compressor and the current applied to the motor based on stroke estimate values and current values during one period and to output an inflection point detect signal;

a stroke reference value corrector configured to determine a stroke estimate value corresponding to a point when the inflection point is generated as a stroke reference value based on the inflection point detect signal; and a stroke controller configured to control the voltage applied to the motor according to the determined stroke reference value.

2. The apparatus of claim 1, further comprising:

a phase difference detector configured to detect the phase difference, wherein the inflection point detector detects the inflection point of the phase difference, and wherein the stroke estimate value corresponding to a point at which the discharge valve of the reciprocating compressor is opened is a stroke estimate value corresponding to a point at which the inflection point is generated.

3. The apparatus of claim 1, further comprising:

a damping coefficient calculator configured to detect the phase difference to calculate a damping coefficient based on the phase difference, the current value and the stroke estimate value, wherein the inflection point detector detects the inflection point of the damping coefficient, and wherein the stroke estimate value corresponding to a point at which the discharge valve of the reciprocating compressor is opened is a stroke estimate value corresponding to a point at which the inflection point is generated.

4. The apparatus of claim 1, further comprising:

a gas spring constant calculator configured to detect the phase difference to calculate a gas spring constant of the reciprocating compressor based on the phase difference, the current value and the stroke estimate value;

wherein the inflection point detector detects the inflection point of the gas spring constant, and wherein the stroke estimate value corresponding to a point at which the discharge valve of the reciprocating compressor is opened is a stroke estimate value corresponding to a point at which the inflection point is generated.

5. A method for controlling an operation of the reciprocating compressor comprising:

calculating a stroke estimate value based on a value of a voltage applied to the reciprocating compressor and a value of a current applied to the reciprocating compressor;

detecting an inflection point based on a phase difference between a stroke of the reciprocating compressor and the current applied to the reciprocating compressor based on stroke estimate values and current values during one period and outputting an inflection point detect signal;

determining a stroke estimate value based on the inflection point corresponding to a point when a discharge valve of the reciprocating compressor is opened as a stroke reference value; and controlling a voltage applied to the reciprocating compressor according to the determined stroke reference value.

6. The method of claim 5, wherein the step of determining the stroke reference value comprises:

detecting the phase difference between the stroke of the reciprocating compressor and the current applied to the reciprocating compressor; and determining the stroke estimate value corresponding to a point at which the inflection point of the phase difference is generated as the stroke reference value.

7. The method of claim 5, wherein the step of determining the stroke reference value comprises:

detecting the phase difference between the stroke of the reciprocating compressor and the current applied to the reciprocating compressor;

calculating a damping coefficient based on the phase difference, the value of the current applied to the reciprocating compressor and the stroke estimate value of the reciprocating compressor; and determining the stroke estimate value corresponding to a point at which the inflection point of the damping coefficient is generated as the stroke reference value.

8. The method of claim 5, wherein the step of determining the stroke reference value comprises:

detecting the phase difference between the stroke of the reciprocating compressor and the current applied to the reciprocating compressor;

calculating a gas spring constant of the reciprocating compressor based on the phase difference, the value of the current applied to the reciprocating compressor and the stroke estimate value of the reciprocating compressor; and determining the stroke estimate value corresponding to a point at which the inflection point of the gas spring constant is generated as the stroke reference value.

9. An apparatus for controlling an operation of the reciprocating compressor comprising:

a stroke calculator for calculating a stroke estimate value based on a value of a voltage applied to a motor of the reciprocating compressor and a value of a current applied to the motor of to reciprocating compressor;

a phase difference detector for detecting a phase difference between a stroke of the reciprocating compressor and the current applied to the motor based on stroke estimate values and current values during one period;

an inflection point detector for detecting an inflection point of the phase difference and outputting an inflection point detect signal;

a stroke reference value corrector for determining a stroke estimate value corresponding to a point when the inflection point is generated as a stroke reference value based on the inflection point detect signal; and a stroke controller for controlling the voltage applied to the motor according to the determined stroke reference value.

10. The apparatus of claim 9, wherein the stroke reference value corrector adds a correction value used for changing the pre-set stroke reference value to the determined stroke estimate value to the pre-set stroke reference value, when the inflection point detect signal is received.

11. An apparatus for controlling an operation of the reciprocating compressor comprising:

a stroke calculator for calculating a stroke estimate value based on a value of a voltage applied to a motor of the reciprocating compressor and a value of a current applied to the motor of the reciprocating compressor;

a damping coefficient calculator for detecting a phase difference between a stroke of the reciprocating compressor and the current applied to the motor based on stroke estimate values and current values during one period and calculating a damping coefficient based on the phase difference, the current value and the stroke estimate value;

an inflection point detector for detecting an inflection point of the damping coefficient and outputting an inflection point detect signal;

a stroke reference value corrector for determining a stroke estimate value corresponding to a point when the inflection point is generated as a stroke reference value based on the inflection point detect signal; and a stroke controller for controlling the voltage applied to the motor according to the determined stroke reference value.

12. The apparatus of claim 11, wherein the stroke reference value corrector adds a correction value used for changing the pre-set stroke reference value to the determined stroke estimate value to the pre-set stroke reference value, when the inflection point detect signal is received.

13. An apparatus for controlling an operation of the reciprocating compressor comprising:

a stroke calculator for calculating a stroke estimate value based on a value of a voltage applied to a motor of the reciprocating compressor and a value of a current applied to the motor of the reciprocating compressor;

a gas spring constant for detecting a phase difference between a stroke of the reciprocating compressor and the current applied to the motor based on stroke estimate values and current values during one period and calculating a gas spring constant of the reciprocating compressor based on the phase difference, the current value and the stroke estimate value;

an inflection point detector for detecting an inflection point of the gas spring constant and outputting an inflection point detect signal;

a stroke reference value corrector for determining a stroke estimate value corresponding to a point when the inflection point is generated as a stroke reference value based on the inflection point detect signal; and a stroke controller for controlling the voltage applied to the motor according to the determined stroke reference value.

14. The apparatus of claim 13, wherein the stroke reference value corrector adds a correction value used for changing the pre-set stroke reference value to the determined stroke estimate value to the pre-set stroke reference value, when the inflection point detect signal is received.

15. A method for controlling an operation of the reciprocating compressor comprising:

calculating a stroke estimate value based on values of a voltage and a current applied to a motor of the reciprocating compressor;

detecting a phase difference between a stroke of the reciprocating compressor and the current applied to the motor based on stroke estimate values and current values during one period;

detecting an inflection point of the phase difference;

determining a stroke estimate value corresponding to a point when the inflection point is generated as a stroke reference value; and controlling the voltage applied to the motor according to the determined stroke reference value.

16. The method of claim 15, further comprising:

controlling the voltage applied to the motor according to a previously determined stroke reference value if the inflection point is not detected.

17. The method of claim 15, wherein, in the step of determining the stroke reference value, a correction value used for changing the pro-set stroke reference value to the determined stoke estimate value, to the pro-set stroke reference value.

18. A method for controlling an operation of the reciprocating compressor comprising:

calculating a stroke estimate value based on values of a voltage and a current applied to a motor of the reciprocating compressor;

detecting a phase difference between a stroke of the reciprocating compressor and the current applied to the motor based on stroke estimate values and current values during one period;

calculating a damping coefficient based on the phase difference, the value of the current and the stroke estimate value;

detecting an inflection point of the damping coefficient;

determining a stroke estimate value corresponding to a point when the inflection point is generated as a stroke reference value; and controlling the voltage applied to the motor according to the determined stroke reference value.

19. A method for controlling an operation of the reciprocating compressor comprising:

calculating a stroke estimate value based on values of a voltage and a current applied to a motor of the reciprocating compressor;

detecting a phase difference between a stroke of the reciprocating compressor and the current applied to die motor based on stroke estimate values and current values during one period;

calculating a gas spring constant of the reciprocating compressor based on the phase difference, the value of the current and the stroke estimate value;

detecting an inflection point of the gas spring constant;

determining a stroke estimate value corresponding to a point when the inflection point is generated as a stroke reference value; and controlling the voltage applied to the motor according to the determined stroke reference value.

20. A method for controlling an operation of the reciprocating compressor comprising:

detecting a phase difference between a stroke of the reciprocating compressor and a current applied to the reciprocating compressor;

determining a stroke estimate value corresponding to a point when an inflection point of the phase difference is generated as a stroke reference value; and controlling a voltage applied to the reciprocating compressors according to the determined stroke reference value.

21. A method for controlling an operation of the reciprocating compressor comprising:

detecting a phase difference between a stroke of the reciprocating compressor and a current applied to the reciprocating compressor;

calculating a damping coefficient based on the phase difference, a value of a current applied to the reciprocating compressor and a stroke estimate value of the reciprocating compressor;

determining a stroke estimate value corresponding to a point when an inflection point of the damping coefficient is generated as a stroke reference value; and controlling a voltage applied to the reciprocating compressors according to the determined stroke reference value.

22. A method for controlling an operation of the reciprocating compressor comprising:

detecting a phase difference between a stroke of the reciprocating compressor and a current applied to the reciprocating compressor;

calculating a gas spring constant of the reciprocating compressor based on the phase difference, a value of a current applied to the reciprocating compressor and a stroke estimate value of the reciprocating compressor;

determining a stroke estimate value corresponding to a point when an inflection point of the gas spring constant is generated as a stroke reference value; and controlling a voltage applied to the reciprocating compressors according to the determined stroke reference value.

23. An apparatus for controlling an operation of a reciprocating compressor which determines a stroke estimate value corresponding to a point when a discharge valve of the reciprocating compressor is opened as a stroke reference value, and controls a voltage applied to the reciprocating compressor according to the determined stroke reference value, the apparatus comprising:

stroke calculator configured to calculate a stroke estimate value based on a value of a voltage applied to a motor of the reciprocating compressor and a value of a current applied to the motor of the reciprocating compressor;

a damping coefficient calculator configured to detect a phase difference between a stroke of the reciprocating compressor and the current applied to the motor based on stroke estimate values and current values during one period and to calculate a damping coefficient based on the phase difference, the current value and the stroke estimate value;

an inflection point detector configured to detect an inflection point of the damping coefficient and to output an inflection point detect signal;

a stroke reference value corrector configured to determine a stroke estimate value corresponding to a point when the inflection point is generated as a stroke reference value based on the inflection point detect signal; and a stroke controller configured to control the voltage applied to the motor according to the determined stroke reference value, wherein the stroke estimate value corresponding to a point at which the discharge valve of the reciprocating compressor is opened is a stroke estimate value corresponding to a point at which the inflection point is generated.

24. An apparatus for controlling an operation of a reciprocating compressor which determines a stroke estimate value corresponding to a point when a discharge valve of the reciprocating compressor is opened as a stoke reference value, and controls a voltage applied to the reciprocating compressor according to the determined stroke reference value, the apparatus comprising:

a stroke calculator configured to calculate a stroke estimate value based on a value of a voltage applied to a motor of the reciprocating compressor and a value of a current applied to the motor of the reciprocating compressor;

a gas spring constant calculator configured to detect a phase difference between a stroke of the reciprocating compressor and the current applied to the motor based on stroke estimate values and current values during one period and to calculate a gas spring constant of the reciprocating compressor based on the phase difference, the current value and the stroke estimate value;

an inflection point detector configured to detect an inflection point of the gas spring constant and to output an inflection point detect signal;

a stroke reference value corrector configured to determine a stroke estimate value corresponding to a point when the inflection point is generated as a stroke reference value based on the inflection point detect signal; and a stroke controller configured to control the voltage applied to the motor according to the determined stroke reference value, wherein the stroke estimate value corresponding to a point at which the discharge valve of the reciprocating compressor is opened is a stroke estimate value corresponding to a point at which the inflection point is generated.

25. A method for controlling an operation of the reciprocating compressor comprising:

determining a stroke estimate value corresponding to a point when a discharge valve of the reciprocating compressor is opened as a stroke reference value;

controlling a voltage applied to the reciprocating compressor according to the determined stroke reference value;

detecting a phase difference between the stroke of the reciprocating compressor and the current applied to the reciprocating compressor;

calculating a damping coefficient based on the phase difference, the value of the current applied to the reciprocating compressor and the stroke estimate value of the reciprocating compressor; and determining the stroke estimate value corresponding to a point at which the inflection point of the damping coefficient is generated as the stroke reference value.

26. A method for controlling an operation of the reciprocating compressor comprising:

determining a stroke estimate value corresponding to a point when a discharge valve of the reciprocating compressor is opened as a stroke reference value;

controlling a voltage applied to the reciprocating compressor according to the determined stroke reference value;

detecting a phase difference between the stroke of the reciprocating compressor and the current applied to the reciprocating compressor;

calculating a gas spring constant of the reciprocating compressor based on the phase difference, the value of the current applied to the reciprocating compressor and the stroke estimate value of the reciprocating compressor; and determining the stroke estimate value corresponding to a point at which the inflection point of the gas spring constant is generated as the stroke reference value.

* * * * *